US009516959B2

(12) United States Patent
Noh

(10) Patent No.: US 9,516,959 B2
(45) Date of Patent: Dec. 13, 2016

(54) HEALTH PILLOW

(76) Inventor: Kwang-Soo Noh, Seoul (KR)

( * ) Notice: Subject to any disclaimer, the term of this patent is extended or adjusted under 35 U.S.C. 154(b) by 0 days.

(21) Appl. No.: 13/636,151

(22) PCT Filed: Feb. 24, 2011

(86) PCT No.: PCT/KR2011/001301
§ 371 (c)(1),
(2), (4) Date: Sep. 20, 2012

(87) PCT Pub. No.: WO2011/118916
PCT Pub. Date: Sep. 29, 2011

(65) Prior Publication Data

US 2013/0007961 A1 Jan. 10, 2013

(30) Foreign Application Priority Data

Mar. 22, 2010 (KR) ..... 10-2010-0025024

(51) Int. Cl.
*A47G 9/10* (2006.01)
*A61H 39/04* (2006.01)
*A61H 7/00* (2006.01)

(52) U.S. Cl.
CPC ..... *A47G 9/1081* (2013.01); *A47G 9/10* (2013.01); *A47G 9/1054* (2013.01); *A61H 39/04* (2013.01); *A61H 7/001* (2013.01); *A61H 2201/0134* (2013.01); *A61H 2201/1284* (2013.01); *A61H 2201/1604* (2013.01); *A61H 2205/022* (2013.01)

(58) Field of Classification Search
CPC ..... A47G 9/10
USPC ..... 5/636–645
See application file for complete search history.

(56) References Cited

U.S. PATENT DOCUMENTS 4,218,792 A 8/1980 Kogan
5,682,632 A * 11/1997 Cotroneo ..... A61G 13/1215 5/636
5,960,494 A * 10/1999 Gilliland et al. ..... 5/638
(Continued)

FOREIGN PATENT DOCUMENTS

JP 10-117905 A 5/1998
JP 03112519 U 7/2005
(Continued)

*Primary Examiner* — Fredrick Conley
(74) *Attorney, Agent, or Firm* — STIP Law Group, LLC

(57) ABSTRACT

The present invention relates to a pillow, which aids a user to sleep soundly when the user is lying on the back, and makes breathing easier and helps stimulate the acupuncture points on the face when the user is lying on the stomach and rests the face on the pillow. To this end, the present invention comprises: a main body; a neck support part, which is formed in the longitudinal direction at the front side of the main body and has a height higher than the height of the main body; a ventilation hole, which penetrates the center of the neck support part into the center of the main body; an incline support part, which is provided on the main body in contact with the ventilation hole, and has a gradual decline towards the ventilation hole; and an acupuncture point stimulation part provided in a protruding manner on the ventilation hole side of the neck support part. The pillow of the present invention aids the user to sleep soundly by forming the ventilation hole at the head resting area, which allows for easy ventilation, ensuring the head to stay cool when the user is lying on the back.

3 Claims, 5 Drawing Sheets

(56) References Cited

U.S. PATENT DOCUMENTS

| | | | | |
|---|---|---|---|---|
| 6,266,832 | B1 * | 7/2001 | Ezell | 5/640 |
| 6,427,272 | B1 * | 8/2002 | Yacoub | 5/638 |
| 7,437,788 | B1 * | 10/2008 | Holman | A47G 9/10 5/636 |
| 2009/0013471 | A1 * | 1/2009 | Yang | 5/640 |

FOREIGN PATENT DOCUMENTS

| | | | |
|---|---|---|---|
| JP | 2006-075488 | A | 3/2006 |
| JP | 2007-050222 | A | 3/2007 |
| KR | 10-0680474 | B1 | 2/2007 |
| KR | 10-0802997 | B1 | 2/2008 |
| KR | 10-0803922 | B1 | 2/2008 |

* cited by examiner

HEALTH PILLOW

TECHNICAL FIELD

The present invention relates to a pillow, and in particular to a health pillow which makes it possible to help a user to have a deep sleep when he lies down on his back and makes it possible to a user to breathe easily even when he lies down on his stomach while ensuring that a user has a good stimulation on an acupuncture point of the face.

BACKGROUND ART

A pillow is generally used to support a user's head for a user to have a deep sleep when he sleeps on his back with the backbone being in a right posture.

A conventional pillow is configured to simply support a user's head while he is sleeping, so the portions between the user's head and the pillow are not well ventilated, which causes the user to sweat a lot while interrupting a user's deep sleep.

So, various kinds of pillows are developed and used, which are made from different materials; however they need improvements in their efficiencies in such a way to adapt a human engineering-based design.

In case of a medical massage or an ordinary massage, when a user is served with it in a hospital or where else in a state he lies down on his stomach, a pillow is rested on a user's face. In this case, the user's nose and mouth are covered, so the user cannot breathe well with the eyes being closed. So, the user is needed to lie down on his side for a long time with the user's face twisted in a lateral direction, which gives a lot of burden to the user's neck, so the user's face contour might deform.

DISCLOSURE OF INVENTION

Accordingly, the present invention is made to improve the above mentioned problems, and it is an object of the present invention to provide a pillow which provides good ventilation between a pillow and a user's head when a user sleeps and makes it possible to help a user to have a deep sleep as the acupuncture point of a user's head is stimulated.

In addition, it is another object of the present invention to provide a pillow which helps a user to breathe easily even when a pillow is rested on a user's face in a state that the user lies down on his stomach and which helps correct an asymmetrical face contour.

To achieve the above objects, there is provided a health pillow, comprising a main body; a neck support part which is longitudinally prolonged from a front side of the main body and has a height higher than the height of the main body; a ventilation hole which is prolonged to the center of the main body while passing through the center of the neck support part; an incline support part which is formed at the main body coming into contact with the ventilation hole and is gradually sloped and lowered in the direction of the ventilation hole; and an acupuncture point stimulation part which is protruded from the neck support part at the side of the ventilation hole.

In addition, the ventilation hole of the present invention comprises a lower ventilation hole coming into contact with the mouth of the user's face; an upper ventilation hole coming into contact with the eyes of the user's face; and a face support part formed between the lower ventilation hole and the upper ventilation hole.

ADVANTAGEOUS EFFECTS

According the pillow of the present invention, when a user lies down on his back for sleeping, a ventilation hole is formed at a portion contacting with a user's head for the purpose of obtaining good ventilation, so sweat is not formed at a user's head, thus helping a user to have a deep sleep.

The pillow of the present invention provides a ventilation hole formed at a portion contacting with a user's face when a user sleeps on his stomach, so the user can easily breathe and open his eyes, thus making a user feel comfortable.

In addition, the pillow of the present invention features in that when a user lies down on his stomach, an incline support part comes to tighten the frame of a user's face, thus correcting an asymmetrical shape of a user' face.

MODES FOR CARRYING OUT THE INVENTION

Figure 1:
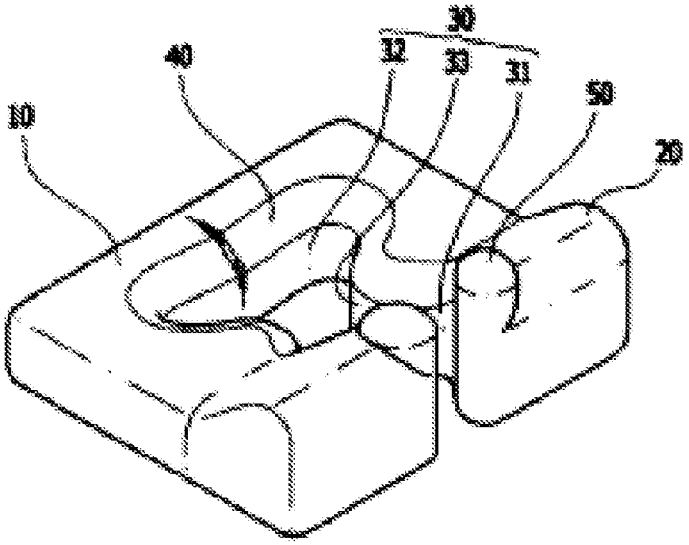
FIG. 1 is a perspective view illustrating a pillow according to the present invention.
Figure 2:
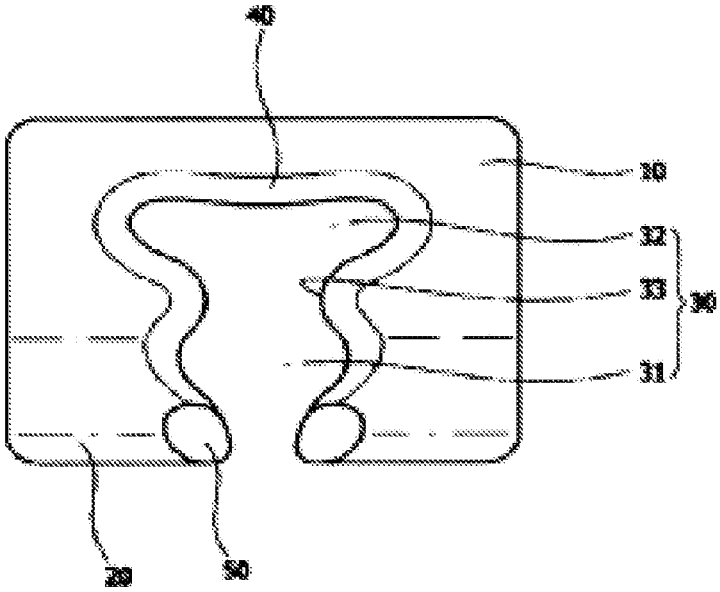
FIG. 2 is a plane view illustrating a pillow according to the present invention.
Figure 3:
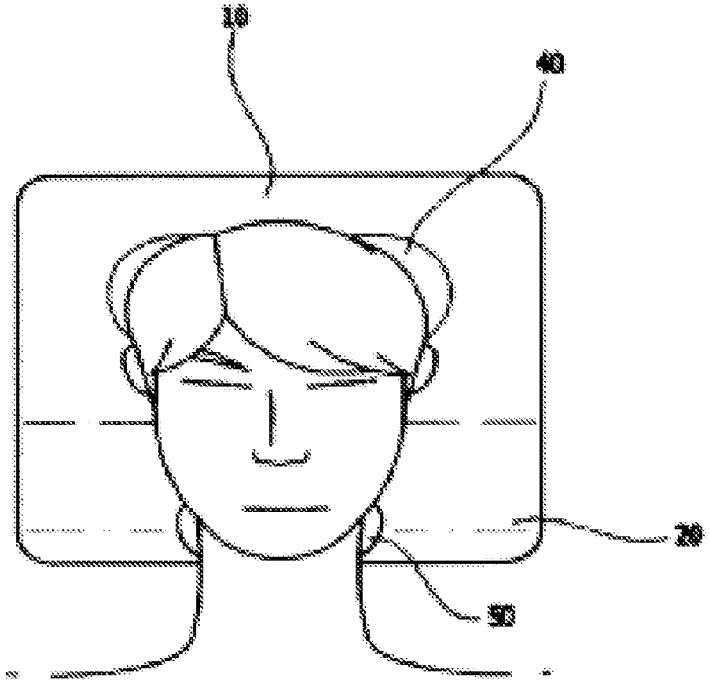
FIG. 3 is a concept view illustrating a state that a user lies down on his back with his head being supported on a pillow according to the present invention.
Figure 4:
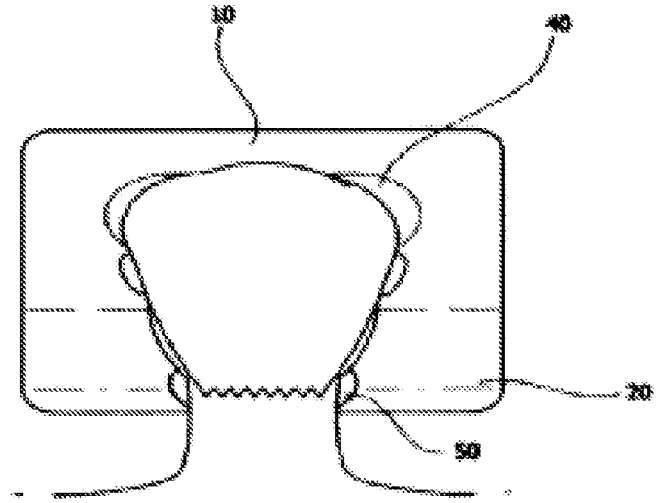
FIG. 4 is a concept view illustrating a state that a user lines down on his side on a pillow with his head being supported on a pillow according to the present invention.
Figure 5:
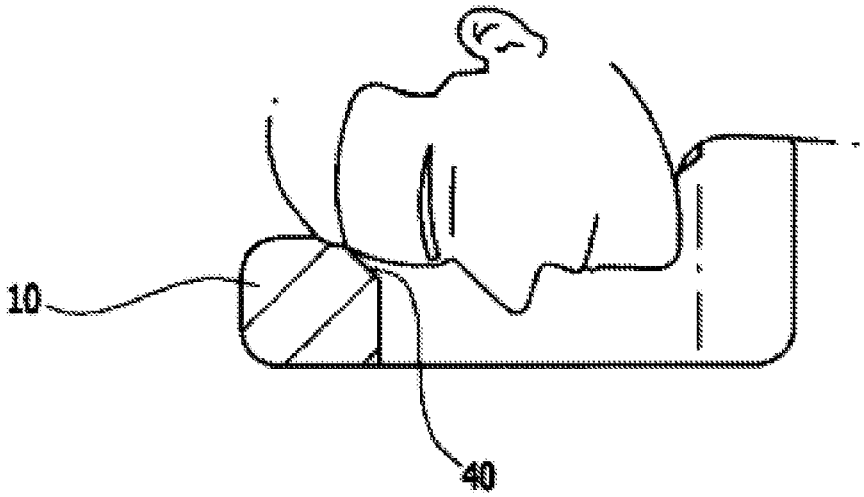
FIG. 5 is a cross-sectional view illustrating a pillow in a state that a user lies down on his stomach with a user's head being supported on the pillow according to the present invention.

The construction according to the most preferred embodiment of the present invention will be described with reference to the accompanying drawings.

The pillow according to the present invention comprises a main body 10, a neck support part 20, a ventilation hole 30, an incline support part 40 and an acupuncture point stimulation part 50.

The main body 10 is made from a flexible polyurethane resin in a quadrangle shape, and the outer surface of it is slightly coated with a coating liquid prepared by mixing a waterproof agent of 20% and an antibacterial and deodorant of 10% with a fiber adsorption agent of 70%.

The neck support part 20 is longitudinally prolonged from a front side of the main body 10 and is formed to have a certain mound higher than the height of the main body 10.

The ventilation hole 30 is prolonged to the center of the main body 10 while passing through the center of the neck support part 20. The ventilation hole 30 is formed of a lower ventilation hole 31 on which the mouth of the user's face is positioned, and an upper ventilation hole 32 on which the eyes of the user's face are positioned. A face support part 33 is formed between the lower ventilation hole 31 and the upper ventilation hole 32.

The incline support part 40 is formed outside the ventilation hole 30 and is gradually sloped and lowered in a direction from the main body 10 to the ventilation hole 30.

The acupuncture point stimulation part 50 is protruded from the neck support part 20 coming into contact with the ventilation hole 30 in a smoothly curved shape.

Hereinafter, the operation of the pillow according to the present invention will be described.

When a user lies down on his back with the pillow being positioned at the back of the user's head, part of the back of the user's head comes into contact with the main body 10, with part of it being positioned on the ventilation hole 30 of the pillow. So, the pillow according to the present invention makes it possible to correct the position of the user's head in place during sleep. In addition, as the neck support part 20 helps support the user's neck, the user can have a deep sleep in a right posture along with a comfortable posture.

At this time, the back of the user's head is spaced apart while not coming into contact with the pillow with the aid of the ventilation hole 30 prolonged from the neck support part 20 to the center of the pillow, which results in good ventilation. So, sweat is not formed at the back of the user's head, so the user can have a deep sleep.

The acupuncture point stimulation part 50 is configured to stimulate the back of the user's head or the Wangu (In the anterior region of the neck, in the depression posteroinferior to the mastoid process) Tianzhu (In the posterior region of the neck, at the same level as the superior border of the spinous process of the second cervical vertebra, in the depression lateral to the trapezius muscle.), Fengchi (In the anterior region of the neck, inferior to the occipital bone, in the depression between the origins of sternocleidomastoid and the trapezius muscles.) acupuncture points of the user's neck in a state that the user lies down on his back, so the user's spirit is refreshed, and the user's fatigue is loosened helping the user's heath.

The operation when a user uses the pillow of the present invention in a state that a user lies down on his stomach will be described.

When a user lies down on his stomach with his face being positioned at the side of the ventilation hole 30, the eyes of the user's face are positioned at the side of the upper ventilation hole 32, and the mouth of the user's face is positioned at the side of the lower ventilation hole 31. In addition, the face support part 33 comes to support both the sides divided about the nose of the user's face.

With the above described construction, the user can breathe easily with the aid of the ventilation hole 30 in a state that the user lies down on his stomach, and the user can keep lying down on his stomach with the eyes open.

In addition, when the user's face is positioned at the side of the ventilation hole 30 in a state that the user lies down on his stomach, the outer side of the face is supported by means of the sloped incline support part 40, so the face muscles are pulled toward the outer side of the face, so the user's face skin keeps tightened.

When the user with an asymmetrical face frame lies down frequently on his stomach with his head being supported by the pillow of the present invention, the user's face is supported by the incline support part 40 which is symmetrical in both directions, so the user's asymmetrical face frame can be naturally, slowly corrected.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

INDUSTRIAL APPLICABILITY

The pillow of the present invention provides a ventilation hole at a portion coming into contact with the user's head when a user lies down on his back with the pillow of the present invention being supported by the user's head for sleeping, so ventilation becomes good, and sweat is not formed at the user's head, so the user can have a deep sleep.

In addition, the pillow of the present invention provides a ventilation hole at a portion coming into contact with the user's face when a user lies down on his stomach, the user can breathe easily and open easily eyes while ensuring comfortable sleeping.

The pillow of the present invention makes it possible to tighten the user's face with the aid of the incline support part when the user lies down on his stomach with the user's face being supported by it, the user's asymmetrical face frame can be corrected, which contributes to the industrial developments.

The invention claimed is:

1. A health pillow, comprising:

a main body;

a neck support part which is longitudinally prolonged from a front side of the main body and has a height higher than the height of the main body;

a ventilation hole which is prolonged to the center of the main body while passing through the center of the neck support part;

an incline support part which is formed at the main body coming into contact with the ventilation hole and is gradually sloped and lowered in the direction of the ventilation hole; and an acupuncture point stimulation part which is protruded from the neck support part at the side of the ventilation hole, wherein the main body is made from a flexible polyurethane resin in a quadrangle shape, and the outer surface of the main body is slightly coated with a coating liquid prepared by mixing a waterproof agent of 20% and an antibacterial and deodorant of 10% with a fiber adsorption agent of 70%.

2. A health pillow according to claim 1, wherein the ventilation hole comprises:

a lower ventilation hole coming into contact with the mouth of the user's face;

an upper ventilation hole coming into contact with the eyes of the user's face; and a face support part formed between the lower ventilation hole and the upper ventilation hole.

3. A health pillow according to claim 1, wherein the acupuncture point stimulation part is in direct contact with, and locally and distinctively protruded from the neck support such that the acupuncture point stimulation part stimulates a substantially small area of the neck or the face.

* * * * *